United States Patent [19]

Dougherty et al.

[11] Patent Number: 4,910,359

[45] Date of Patent: Mar. 20, 1990

[54] UNIVERSAL CORDAGE FOR TRANSMITTING COMMUNICATIONS SIGNALS

[75] Inventors: Timothy S. Dougherty; Robert E. Streich, both of Phoenix, Ariz.

[73] Assignee: American Telephone and Telegraph Company, AT&T Technologies, Inc., Berkeley Heights, N.J.

[21] Appl. No.: 264,603

[22] Filed: Oct. 31, 1988

[51] Int. Cl.[4] ..... H01B 7/06; H01B 7/02

[52] U.S. Cl. ..... 174/69; 174/110 V; 174/117 F; 174/120 SR

[58] Field of Search ..... 174/69, 110 V, 112, 174/113 R, 113 C, 117 F, 120 R, 120 SR; 439/502

[56] References Cited

U.S. PATENT DOCUMENTS

| | | | |
|---|---|---|---|
| 3,699,498 | 10/1972 | Hardesty et al. | 439/248 |
| 3,761,869 | 9/1973 | Hardesty et al. | 439/418 |
| 3,860,316 | 1/1975 | Hardesty | 439/344 |
| 3,941,908 | 3/1976 | Valia et al. | 174/69 X |
| 4,090,763 | 5/1978 | Congdon et al. | 174/113 C X |
| 4,148,539 | 4/1979 | Hardesty | 439/418 |
| 4,166,881 | 9/1979 | Congdon et al. | 174/69 X |
| 4,277,642 | 7/1981 | Piper et al. | 174/117 F |
| 4,346,145 | 8/1982 | Choi et al. | 174/120 SR X |
| 4,375,012 | 2/1983 | Cocco et al. | 174/69 |

FOREIGN PATENT DOCUMENTS

| | | | |
|---|---|---|---|
| 947390 | 5/1974 | Canada | 174/120 R |
| 3414913 | 10/1985 | Fed. Rep. of Germany | 174/69 |

*Primary Examiner*—Laramie E. Askin

*Attorney, Agent, or Firm*—Edward W. Somers

[57] ABSTRACT

Cordage (17) which may be used for any of the commonly marketed lengths of retractile cords comprises an array of a plurality of conductors (11—11) each insulated with a suitable plastic material. The array of conductors is enclosed in inner and outer jackets (52, 54). The inner jacket comprises a polyvinyl chloride (PVC) plastic material, for example, and has a thickness of about 0.015 inch. Covering the inner jacket is an outer jacket comprising a polyvinyl chloride plastic material having a thickness of about 0.005 inch and having a colorant constituent. The PVC composition of the inner jacket is such that it is a less expensive composition than that of the outer jacket. Enclosing the outer jacket is a layer (56) which comprises a top coating material. The top coating material provides the cordage with enhanced retractibility and prevents discoloration as well as plasticizer migration from the outer jacket.

18 Claims, 4 Drawing Sheets

UNIVERSAL CORDAGE FOR TRANSMITTING COMMUNICATIONS SIGNALS

TECHNICAL FIELD

This invention relates to a universal cordage for use in communications. More particularly, it relates to cordage which includes a skin coating of a relatively high modulus material and which may be used for any commonly sold length retractile cord.

BACKGROUND OF THE INVENTION

Cords used on telephone instruments to connect a handset to a base must have sufficient retractility to ensure that they will return promptly to their normal retracted form after having been extended and then released. However, such cords which are commonly known as retractile or spring cords must not be so strongly retractile that they require an excessive amount of force to extend them. If a retractile cord is too unyielding, instead of the cord extending when a pull is exerted thereon, the instrument to which it is attached may be moved on or pulled from its support. Readily extensible retractile cords are desirable, particularly when the retractile cords are connected to lightweight desk-type or bedroom-type telephone handsets. Further, it is economically desirable to obtain an extended length with as short a length of cordage as possible. From an appearance standpoint, it also is desirable that the retracted length of the retractile cord be as short as possible.

Suitable retractility is especially important for cords used on wall mounted telephones. Should the cord not have sufficient retractility, it will sag in an unsightly manner.

Retractile cords of the type used on telephone instruments are generally constructed of highly flexible cordage having a plurality of individually insulated, mandrelated tinsel conductors. Each of these tinsel conductors is made by wrapping a plurality of thin tinsel ribbons of a Phosphor-bronze material, for example, spirally around a multi-filament nylon center core. The tinsel conductor is suitably insulated and, subsequently, the plurality of individually insulated conductors may be jacketed with a plasticized polyvinyl chloride (PVC) composition. The wound cordage is subjected to a heat-treating temperature after which it is removed from a mandrel while the helical direction of the wind is reversed. This construction permits repetitive flexure of the cordage for a relatively large number of times as encountered during normal usage and also permits the cordage to be wound helically during the formation of the retractile cords.

A modular concept in telephone cordage design includes the replacement of individual spade-tipped conductors with a modular plug. Jacks adapted to receive the plugs are mounted in a telephone housing or base and in a wall terminal thereby permitting easy replacement of either the line or retractile cord by a customer or an installer. See, for example, U.S. Pat. Nos. 3,699,498 and 3,761,869 issued Oct. 17, 1972 and Sept. 25, 1973, respectively in the names of E. C. Hardesty, C. L. Krumreich, A. E. Mulbarger, Jr. and S. W. Walden, and U.S. Pat. No. 3,860,316 issued Jan. 14, 1975 in the name of E. C. Hardesty.

Conversion to modularity and its associated plug-terminated cordage necessitated the development of telephone cordage having a smaller cross-section than that used in the past. A cordage design suitable for use with the modular plugs incorporated smaller cross section conductors arranged in a parallel relationship, positioned in a single plane, and encapsulated with a somewhat oval-shaped jacket. In addition to reduced installation costs, the modular cord design offered other potential benefits such as, for example, (1) smaller, lighter weight telephone cords requiring less PVC; (2) inplant mechanization of cord finishing thereby eliminating manual operations; and (3) replacement of the various color-coded conductors with a single color made possible by the single plane parallel arrangement of conductors for easy identification.

As mentioned hereinabove, the dimensional constraints imposed by the modular plugs and jacks necessitated a reduction in the overall size of both the insulated conductors and jacketed, oval-shaped flat cordage. To reduce the size of the insulated conductor, it became necessary to eliminate a priorly used knitted nylon covering over the served tinsel. The elimination of the protective nylon knit made it necessary to develop a tough insulation material which would function as a high strength barrier to the cutting action of the tinsel ribbons, as an electrical insulation over the tinsel conductor, and as the primary component to achieve resiliency in a retractile telephone cord. A plasticized nylon insulation replaced the knitted nylon covering over the served tinsel conductor and the outer PVC insulation material over the knit.

Subsequently, the individual conductor insulation was changed to include a polyether polyester copolymer composition obtained by reacting 1,4 butane diol terephthalate with terephthalate esters of polyetetramethylene glycol (PTMEG). Such an insulation composition is available commercially from the E. I. DuPont de Nemours Co. under the designation HYTREL ® plastic material. It causes the cordage to have excellent retractility, but is relatively expensive. The use of such an insulation material for cordage is disclosed in U.S. Pat. No. 4,090,763 which issued on May 23, 1978 in the names of W. I. Congdon, et al. and which is incorporated by reference hereinto. The insulation composition also may include a color concentrate comprising a second polyester copolymer which unexpectedly functions as a processing aid when extrusion-coating the composition about the tinsel conductor.

Typically, a relatively flexible PVC is used to jacket the cordage comprising a plurality of insulated conductors. Flexible PVC is made using a range of types and amounts of plasticizers. These materials soften the normally rigid PVC and impart the desired degree of flexibility. However, the plasticizers rarely are very soluble in PVC, and they tend to migrate out of the base material and enter the environment. Migration is a problem from a cosmetic standpoint because the commonly used plasticizers absorb stains during use and migrate back into the surface of the plastic along with the staining substance where they cannot be removed conveniently but where nevertheless they are visible.

In telephone applications, the cords typically have high visibility coupled with high exposure to wear, staining and environmental degradation. Black cords suffer little from staining and only moderately from degradation. However, the increasing demand for cords that are coordinated in color with appliances or interior decor places stringent demands on the PVC jacketing. Staining and discoloration are significant problems, especially with equipment that receives heavy use and has a long service life.

The problems of plasticizer migration and staining are overcome by coating the clear or colored PVC jacket with a barrier layer to prevent interaction between the plasticizer and a potential staining substance. The barrier layer may be a coating of a polyester blend that itself is clear as applied to the cord, and which adheres well to plasticized PVC, is abrasion resistant, flexible, has long term stability against heat and light, can be processed by conventional extrusion, and is itself resistant to stains and discoloration. Such a barrier or top coating, as it is called, is disclosed in U.S. Pat. No. 4,166,881 which issued on Sept. 4, 1979 in the names of W. I. Congdon, et al. The barrier layer, which is relatively expensive, also is effective to provide enhanced retractility for the cordage.

With regard to the coloring of the cordage jacket, more is required than simply to add a standard color constituent. Cords must be provided with jackets which are closely color matched with the colors of the telephone sets to which they are to be connected. To provide a PVC composition which is to be used as the cord jacket with a suitable coloring constituent becomes expensive.

Also, telephone cords are made in varying lengths for varying uses. A typical desk phone, for example, includes a retractile cord which when extended has a length of six feet. A twelve foot retractile cord may be used for wall telephones or for desk phones. For wall telephones, particularly those used in kitchens, cordage having an extended length of twenty-five feet is commonplace.

For the six foot cords, retractility has been achieved and maintained with the conductors being insulated with a thermoplastic elastomeric insulation which is available from the Shell Chemical Co. under the trade designation ELEXAR® 8481. Because of the relatively short length, a top coating which provides enhanced retractility need not be added to the outer surface of the jacket of the six foot cord.

As one can imagine, as the length of the cord increases, the retractility of the cordage is more difficult to maintain, particularly over time. Twelve foot cords must include provisions for enhanced retractility. This has been accomplished by insulating the conductors of cordage to be used to make twelve foot cords with HYTREL® plastic material.

For the twenty-five foot cord, particularly one which forms a catenary from the base and handset of a wall-mounted telephone, particular attention must be given to the retractile properties of the cordage. For such a relatively long length, the weight of the cord causes sagging. In this instance, the cordage includes conductors insulated with the ELEXAR® plastic material and a top coating applied over the cordage jacket. Because the top coating material adds so much to its retractility, the cordage for twenty-five foot cords is tapered with convolutions at each end having a diameter less than the diameter of those in the middle. Tapering the cord helps to control the extensibility and the retractility of the cord. Such a tapered cord structure is disclosed in U.S. Pat. No. 4,375,012 which issued on Feb. 22, 1983 in the names of E. R. Cocco, et al.

As a result of efforts to meet cost and performance requirements, three different length cords comprising three different designs must be inventoried. Because the top coating material is relatively expensive, it has not been used on the six and twelve foot cords. Instead, the six foot retractility requirements have been met with ELEXAR® plastic material as the insulation for the conductors and the twelve foot cord requirements met with the more expensive HYTREL® conductor insulation.

As should be apparent, the above requirements and the means for meeting these jacketing requirements have led to costs which are higher than if a universally jacketed cordage were available for all lengths. One could be led to suggest cordage having a top coating be used for any length cordage. However, the top coating material is relatively expensive and its universal use as a portion of the jacket system could affect the cost competitiveness of domestic-produced cordage with respect to those produced out of the country.

What is needed and seemingly what is not available is a cordage structure which may be used for any customary length cord but one which will not adversely affect the cost of any such length cord. Hopefully, such a sought-after cordage will comprise materials currently available in the marketplace and involve manufacturing processes and apparatus which are relatively easy to implement.

SUMMARY OF THE INVENTION

The foregoing problems of the prior art have been overcome by the cordage of this invention. Such a cordage includes at least one signal communications medium which is insulated with a suitable plastic material and which is enclosed in a jacket system. The jacket system includes an inner jacket which comprises a plastic material such as plasticized polyvinyl chloride or a cellular plastic material and an outer jacket which is relatively thin compared to the inner jacket. The outer jacket may include a colorant constituent which causes the color of the cordage to be matched to that of the telephone to which the cordage is connected. Significant costs are involved in attaining the color match between cord and telephone. The outer jacket comprises a PVC whose color has been controlled within 2 units of total color difference expressed in CIELAB units.

Enclosing the outer jacket is a layer of a top coating which in a preferred embodiment is transparent to expose the color of the outer jacket. Superior top coating materials for PVC are elastomeric copolyesters. One embodiment includes a polyester blend of a terpolymer of tetramethylene glycol reacted with terephthalic acid, isophthalic acid, and azelaic acid, and a copolymer of ethylene glycol reacted with terephthalic acid and sebasic acid.

Advantageously, the top coating layer bonds chemically to the outer jacket. Also, the outer and the inner jackets bond to each other. As a result, there is no slippage between plastic layers and the cord jacketing system effectively is a monolithic structure.

The foregoing jacketing structure is adaptable as a universal cordage jacketing system for common length cords. Coloring is provided in the relatively thin outer jacket. Superior retractility is achieved by the combination of the conductor insulation and the top coating. The cordage is cost-competitive because the substantial majority of the jacketing comprises a relatively low cost inner jacket of PVC which is not colored and which may comprise a cellular material, for example. For the longest cords, ELEXAR® 8481 material continues to be used for the conductor insulation, and a suitable top coating material and tapering of the cordage are used to provide the desired retractility. For the twelve foot cords, the conductor insulation may be the same plastic material as that used on the twenty five foot cords which is less expensive than that used presently on twelve foot cords, and the retractility is provided by a suitable top coating material. For the six foot cords, the cordage of this invention includes a top coating material. Also, for the short cords, the same insulation material as that used now, that is the ELEXAR® 8481 plastic material, may be used and the cordage may be tapered to increase extensibility. In the alternative, a polypropylene insulation or a polypropylene insulation and tapering may be used for the short cords. This may increase the cost of the new six foot cord over the present one, but the increase, if any, will be slight because of the savings in the jacketing materials. Also, significant inventory savings will be realized by being able to make any customary length cord with a universal cordage.

BRIEF DESCRIPTION OF THE DRAWING

Other objects and features of the present invention will be more readily understood from the following detailed description of specific embodiments thereof, when read in conjunction with the accompanying drawings, in which.

DETAILED DESCRIPTION

Figure 1:
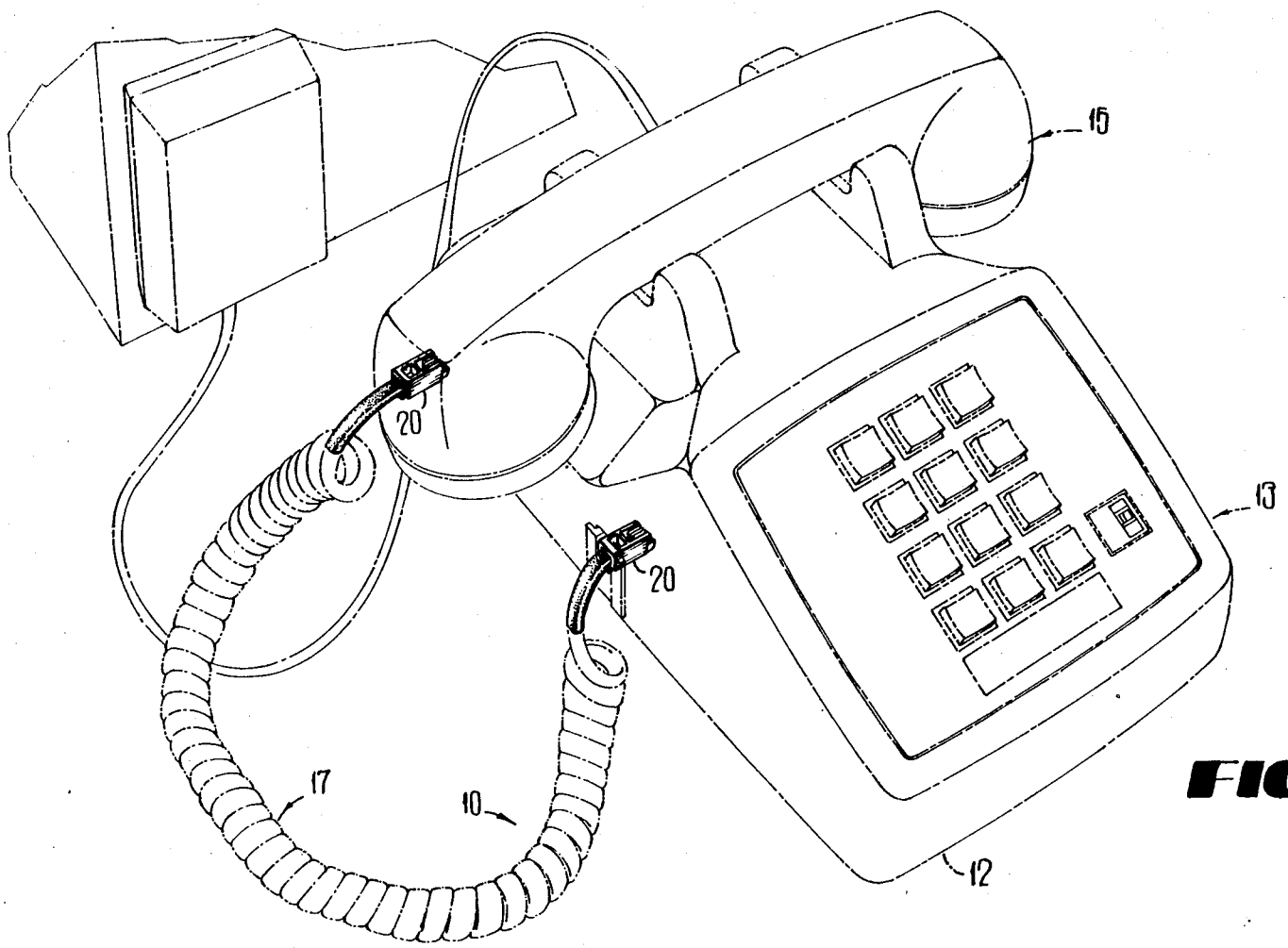
FIG. 1 is a perspective view of telephone station apparatus which is interconnected by cordage of this invention.

Referring now to FIG. 1 of the drawings, there is shown a retractile or spring cord, designated generally by the numeral 10. It should be understood that although the invention is described in terms of a retractile cord, the principles of this invention are not so limited and are applicable generally to cordage which includes a jacketed plurality of individual conductors.

Figure 2:
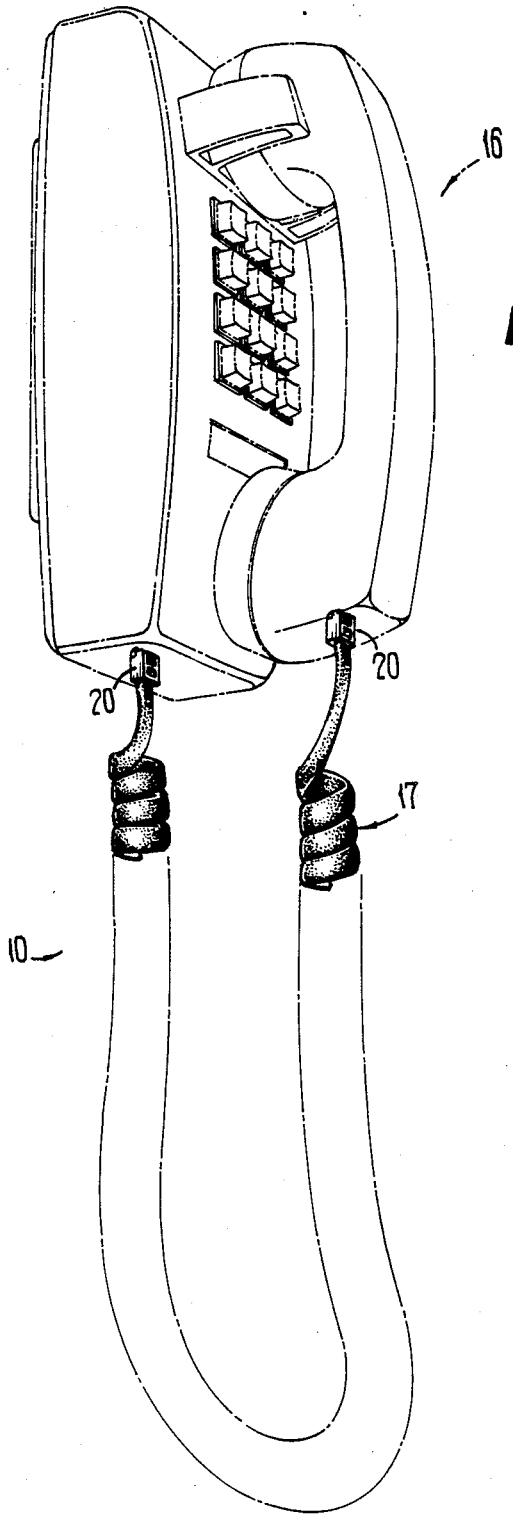
FIG. 2 is a perspective view of a wall mounted telephone having portions thereof connected by cordage of this invention.

The retractile cord 10 is the type which is used to connect a base 12 (see FIG. 1) of a telephone 13 to a handset 15. Not only may the cord 10 be used for a telephone supported by furniture, for example, but it also may be used for a wall mounted telephone 16 (see FIG. 2). Typically, twelve or twenty-five foot cords are used for wall telephones and but for special provisions would tend to sag over time.

Figure 4:
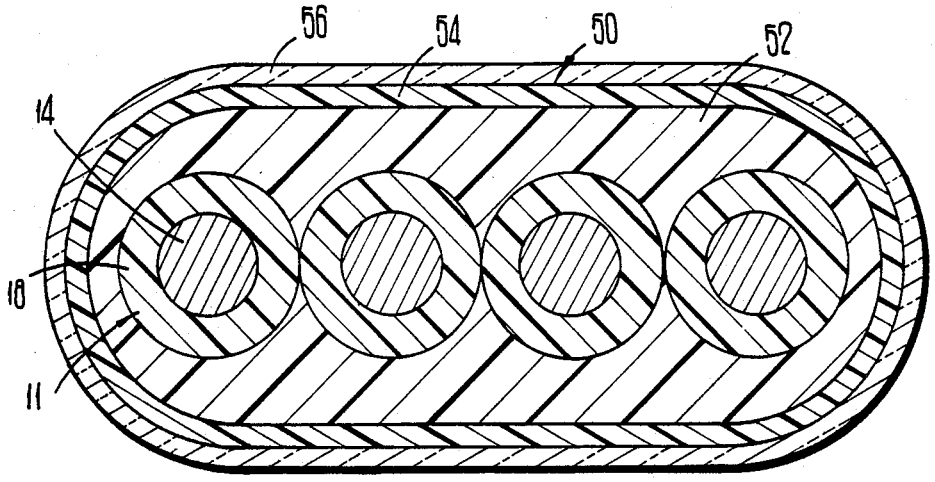
FIG. 4 is an end cross sectional view of a length of cordage which shows insulated conductors and a jacketing system.
Figure 3:
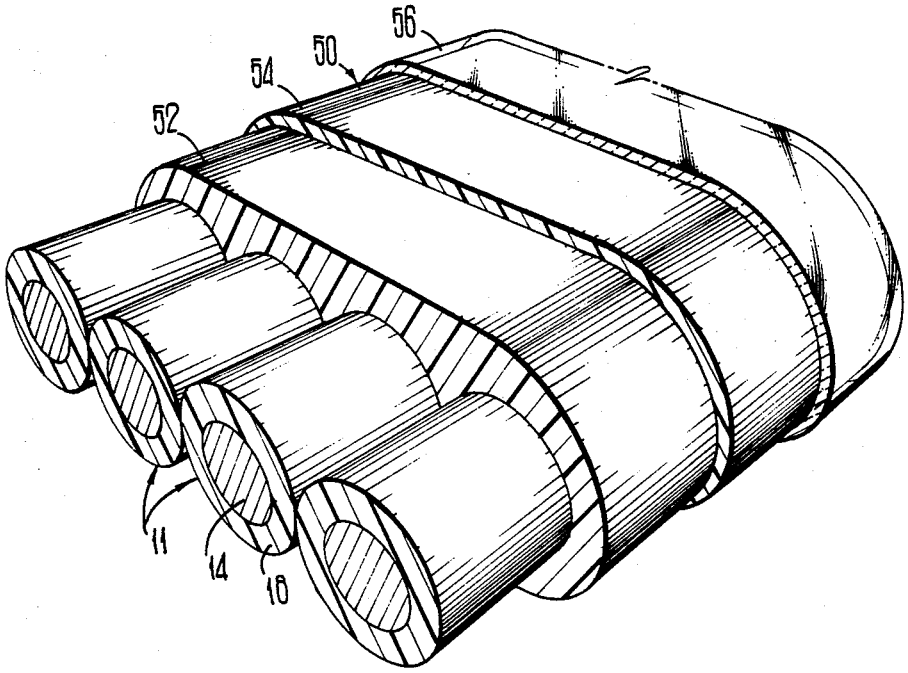
FIG. 3 is a perspective view of a length of telephone cordage of this invention.

The cord 10 comprises a length of retractile cordage 17 which includes a plurality of insulated tinsel conductors designated by the numerals 11—11 (see FIG. 3). Each of the insulated tinsel conductors 11—11 includes a nylon multi-filament center core about which a plurality of tinsel ribbons, made typically from a high strength bronze alloy such as cadmium-copper or Phosphor-bronze material, for example, are wrapped spirally to form a tinsel conductor, designated by the numeral 14 (see FIGS. 3 and 4).

An insulating covering 18 of a suitable plastic material is extrusion-tubed over the tinsel conductor 14 to form one of the insulated tinsel conductors 11—11. The served tinsel conductor construction provides a high degree of flexibility and fatigue life as compared to a solid conductor design.

Each end of the cord 10 is terminated preferably with a modular plug 20 (see FIG. 1). A modular plug which may be used to terminate an end of the cordage is disclosed in U.S. Pat. No. 4,148,539 which issued on Apr. 10, 1979 in the name of E. C. Hardesty.

The insulation material which is used for the conductor 11—11 may depend on the length of the cord which is made from the cordage. For cordage which is to be used to provide six foot, and twelve foot and twenty-five foot cords, an ELEXAR® thermoplastic elastomer blend which is available from the Shell Chemical Co. is preferred. This material is a physical blend of polypropylene material and a styrene-ethylene butene-styrene block copolymer. The material provides excellent retractility and extensibility properties.

It should be realized that other materials may be used for the conductor insulation. What is important is that it have suitable extensibility and retractile properties and that it has a melt point above the temperature at which the cordage is heat set in a retractile configuration. Polypropylene also may be useful as the conductor insulation material for the cordage of this invention.

Figure 5:
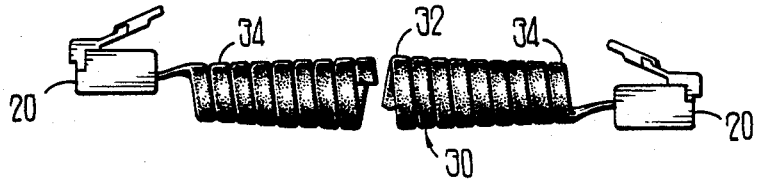
FIG. 5 is an elevational view of a tapered cord.

Should the cordage have too much retractility and insufficient extensibility, the conductors may be insulated with polypropylene and/or the cordage may be tapered to provide a cord 30 (see FIG. 5) in which the convolutions in a center portion 32 have a larger diameter than those of end portions 34—34. See priorly mentioned U.S. Pat. No. 4,375,012 which issued on Feb. 22, 1983 in the names of E. R. Cocco, et al. and which is incorporated by reference hereinto.

The conductor insulation 18 is applied by using a tubed extrusion technique in which there is provided an air-induced space between the served tinsel coductor 14 and the tubed insulation 18. Extrusion of the insulation composition is affected by extrusion temperatures and screw design because the insulation composition is characterized by rapid changes in melt viscosity with slight variations of polymer temperature. Further, the material undergoes a rapid transition between liquid and solid phases. These characteristics could result in non-uniform wall thicknesses and polymer flow pulsations.

The air-induced space between the tinsel conductor 14 and the insulation 18 allows the conductor to move freely within the insulation thereby reducing conductor fatigue. With an average conductor outside diameter of about 20 mils and the size limitation imposed by a modular terminated cord 10, the tubular insulation 18 is limited to an outside diameter of not greater than 40 mils. The criticality of the outside diameter, coupled with a 2 mil air space, necessitates a tubular wall thickness of about 8 mils. This thin wall construction mandates that the insulation material possesses excellent mechanical strength, such as, for example, cut-through resistance, hardness, tensile and compression strength.

A plurality of the insulated tinsel conductors 11—11 are arranged in parallel, nontwisted, contiguous relationship with respect to each other (see FIGS. 3 and 4) so that the insulated conductors are symmetrical with respect to a common longitudinal axis therebetween. Enclosing the individually insulated conductors is a jacket system which is designated generally by the numeral 50. The jacket system 50 comprises an inner jacket 52, an outer jacket 54 and a layer 56 of a top coating material.

The inner jacket may comprise a polyvinyl chloride (PVC) composition such as one which may include the following constituents. The basic polymer which is utilized in the composition of the inner jacket is a PVC resin, a homopolymer. The PVC resin has all of the characteristics associated with a homopolymer which includes some abrasion resistance, but which in and of itself is heat unstable. Further, the PVC must be a suitable electrical grade PVC homopolymer.

Commercial PVC polymers which may contain up to 20 percent or preferably to a maximum of 10 percent by weight of comonomers or other admixed material such as propylene may be used without significant adverse effect. For example, PVC acetate or PVC propylene may also be used.

In accordance with the A.S.T.M. standard for 1966, suitable compounds may be classified as within the range of from GP-$\bar{4}$-00005 to GP-$\bar{7}$-00005 inclusive. Definitions of these characteristics are set forth in the ASTM standard under designation D1755-66. Very briefly, the designation, GP, designates a general purpose resin. The first numerals (entries 4 through 7) represent a polymer molecular weight in terms of solution viscosity and the last digit, 5, indicates the usual preference for an electrical conductivity less than 18 ohms per centimeter per gram. The bar under or the bar over a numeral indicates a value less than or more than, respectively, the numeral. The four ciphers in the designations indicate that the properties of particle size, apparent bulk density, plasticizer absorption and dry flow may be any A.S.T.M. designated level, i.e., 1–9. A suitable PVC is one designated Geon® 85 which is available from the B. F. Goodrich Company and which has an inherent viscosity of 0.76 and a relative viscosity of 1.96.

It is convenient to discuss concentrations in terms of parts by weight based on 100 parts of PVC homopolymer. Concentrations so designated, therefore, result in compositions, having greater than 100 parts.

Combined with the polyvinyl chloride resin to facilitate processing, including the extrusion of the composition, is a plasticizer such as a monomeric plasticizer, such as a phthalate plasticizer, or a phosphate plasticizer, for example. The choice of a monomeric plasticizer must be an acceptable low temperature plasticizer. An acceptable low temperature plasticizer is one which combines with the PVC resin so as to become inserted between the molecules of the resin.

A problem arises in attempting to optimize the monomeric plasticizer. Plasticizers are members of the ester family which includes straight chain esters and branch chain esters. The straight chain ester materials are more effective in maintaining flexibility at low temperatures than branch chain materials. But branch chain esters have some advantages such as better lacquer-mar characteristics over straight chain esters.

Many monomeric plasticizers may be used, but depending on the choice, varying properties in the areas of low temperature flexibility and lacquer-mar resistance are obtained. The choice of a monomeric plasticizer must be made as a function of the requirements of the overall composition.

A suitable plasticizer must be such that flame retardancy requirements deemed necessary for customer installation are met. A minimum limiting oxygen index (L.O.I) of 26 must be achieved. Needless to say, the plasticizer is an essential part of the inventive composition in that the plasticizer is the constituent which is of assistance in achieving a minimum limiting oxygen index of 26.

A preferred concentration added to the polyvinyl chloride resin is about 50–60 parts and preferably 50 parts by weight of the plasticizer to 100 parts by weight of the homopolymer. If less than about 50 parts are employed, the composition would have poorer low temperature flexing properties and poorer long term heat stability. If more than 60 parts are employed, the L.O.I. of the composition begins to decrease and the lacquer-mar resistance of the composition is reduced.

The phthalate plasticizer employed in a composition of the inner jacket may be an alkyl-phthalate. It has been found that Palatinol® 711 as marketed by the BASF Corporation is a suitable plasticizer.

Combined with the polyvinyl chloride resin and the plasticizer is a metallic stabilizer system which may or may not have a liquid carrier. The aforementioned constituent permits the composition to be applied by an extrusion apparatus.

A suitable metallic stabilizer may be selected, for example, from the group consisting of a metallic stabilizer containing a phosphite chelator, a barium stearate, a cadmium-stearate, a barium-ethylhexoate, a barium-cadmium laurate and a barium cadmium myristate. A metallic stabilizer containing a phosphite chelator includes a barium-cadmium-zinc phosphite stabilizer or a barium-cadmium phosphite. The use of three metallic constituents provides early, intermediate and long term heat stability while the chelator optimizes the effectiveness of these constituents.

The metallic stabilizer may be present in solid form or dispersed in a carrier. A preferred carrier may include an organic solvent. It has been found that a liquid metallic stabilizer has certain advantages. A liquid metallic stabilizer may be added to the compounding mixture together with the other liquid constituents such as the plasticizers and the other stabilizers to benefit the composition at a very early stage of preparation. This stabilizer may be defined as being an emulsion or suspension of the materials in an organic solvent carrier. This dispersion of metals in an organic solution interacts with the polyvinyl chloride and is employed to aid the extrusion process and provide stability.

A preferred concentration added to the polyvinyl chloride resin and the plasticizers is about 2 to 5 parts by weight of a metallic stabilizer to 100 parts by weight of the homopolymer. If less than 2 parts are used, the heat stability of the composition is reduced. More than 5 parts detracts from the heat stability of the composition.

An acceptable stabilizer which has been found suitable for the inner jacket 52 is available commercially from the Ferro Company under the designation Ferro® 6196W. The Ferro® 6196W stabilizer comprises a cadmium benzoate and zinc stearate alkyl salt stabilizer material.

Also included in the composition of the inner jacket is a flame retardant constituent such as antimony trixoide, for example. This constituent is provided in the amount of 2 parts by weight per 100 parts by weight of the PVC. One such antimony trioxide is available commercially from Anzon America, Inc. and is a pigment grade antimony trioxide.

Further, part of the composition of the inner jacket is a filler material such as a calcium carbonate filler which is used to extend the PVC. This avoids the need for more expensive constituents and allows more coverage per unit cost. A suitable filler is one which is available under the designation Verifine ®-T available commercially from the White Corp. of Florence, Vt. and which has a mean particle size of 1.0 μm. Filler is included in the composition of the inner jacket in the amount of about 45 parts by weight to 100 parts by weight of PVC.

The inner jacket 52 is such that in the cross section of the cordage, the width is about 0.167 inch and the height is about 0.067 inch. These dimensions are such that the cordage may be terminated by conventional modular plugs 20—20.

Over the inner jacket is disposed the outer jacket 54. The outer jacket comprises a suitable extrudable plastic material. The outer jacket 54 may be clear or it may include a colorant constituent. As will be seen, the outer jacket comprises a composition of matter which includes substantially less filler. However, by using a less expensive composition for the inner jacket and the more expensive for a relatively thin outer jacket, i.e. about 0.005 inch thick, cost savings are effected.

The basic polymer which is utilized in the composition of the outer jacket is a PVC resin, a homopolymer. A preferred PVC resin for the composition of the outer jacket is Geon ® 85 PVC which also is used for the inner jacket.

Combined with the PVC resin is a suitable plasticizer such as Palatinol ® 711 in an amount of about 55 parts by weight per 100 parts by weight of the PVC resin. Unsuitable plasticizing constituents within the composition tend to exude from the cord onto the lacquered surface of table tops on which a telephone handset may be supported. This extractive process causes a streak to appear on the portion of the table top which had been in engagement with the cord. This consideration may become important if the jacket 54 comprises the outermost material of the cordage.

Also included in the composition of the outer jacket 54 is a stabilizer system comprising, for example, 3 parts by weight of Ferro ® 6136W per 100 parts by weight of PVC. For the outer jacket 54 the composition also includes a second stabilizer such as an alkyl aryl liquid phosphite stabilizer which adds synergistically to the stabilizer system. Such a stabilizer is available from the Ferro Corporation under the designation Ferro ® 904 and is included in the composition in the amount of about 0.5 part by weight per 100 parts by weight of PVC. Further, included in composition of the outer jacket is a flame retardant constituent such as antimony trioxide in an amount of about 3 parts by weight per 100 parts by weight of PVC. Also, a filler such as Verifine ®-T calcium carbonate is used, but unlike in the composition of the inner jacket, only in the amount of about 10 parts by weight per 100 parts by weight of PVC.

A lubricant is combined with the PVC, the plasticizer, the flame retardant constituent, the filler and the stabilizers. The lubricant used in this composition may, for example, include a metallic stearate or a stearic acid. Functionally, the lubricant (1) adds synergistically to the maintenance of the clarity by helping to avoid yellowing, (2) adds to the heat stability of the composition, and (3) provides lubrication of the composition in the manufacturing process.

The lubrication of the composition ensures that all of the constituents blend together to obtain a homogeneous mix with an accompanying reduction of internal friction. The lubricant also is of assistance in causing the composition to be moved onto the extrusion screw, to be melted and to be extruded therefrom in a uniform state in an even flow.

Preferably, a concentration added to the PVC is 0.25 to 1 part by weight of the lubricant to 100 parts by weight of the PVC material. If less than 0.25 part is used, the flow and hence the extrudability of the composition is reduced. Also, the use of a portion of a part outside the low end of the range causes poor mixing, poor flexing, internal heat buildup in processing, reduced heat stability and high shear forces which leads to burn-up of the material in processing. On the other hand, the use of more than 1 part overlubricates and causes slippage in the extruder.

A technical grade stearic acid lubricant available commercially from Emery Industries under the designation Emersol ® 120 has been found to be a suitable lubricant. Emersol ® 120 has a melting point of 53°–54° C. and is double-press dispersed into a fine powder form to be capable of a more complete dispersion in the overall composition. Preferably, the composition of the outer jacket includes about 0.5 part by weight of the lubricant per 100 parts by weight of PVC.

Also added to the composition of the outer jacket is a colorant constituent. The colorant constituent must be such that the color of the cordage is closely matched to that of the telephone set to which it is connected. Advantageously, because the amount of plastic material required to form the outer jacket is substantially less than that required for the inner jacket, the cost of the colorant constituent is much less than if one jacket with a colorant material were used for the entire jacket.

In order to provide enhanced retractibility for the cordage 17 and to protect further the cordage against mechanical and other damage such as discoloration on aging, the outer jacket 54 is provided with a top coating 56. The layer of top coating material has a thickness of about 0.004 inch about the periphery of the outer jacket 54.

It was concluded from testing that an elastomeric copolyester composition such as one designated VAR 10013-A which is available from the Goodyear Company is preferred and provides excellent barrier and stain resistant qualities. VAR 10013-A is a designation for a random linear copolyester containing units of terephthalic acid, polytetramethylene glycol and dimer acid. The copolymers are elastic materials. See U.S. Pat. No. Re. 31,270 which is incorporated by reference hereinto.

Another embodiment of the top coating material is disclosed in earlier mentioned U.S. Pat. No. 4,166,881 which is incorporated by reference hereinto. It comprises polyesters, especially a polyester blend of a terpolymer of tetramethylene glycol reacted with terephthalic acid, isophthalic acid and azealic acid, and a copolymer of ethylene glycol reacted with terephthalic acid and sebasic acid.

This last mentioned top coating material may be one marketed by Goodyear under the designation VAR 5825. This last material is a polyester blend of: (1) a terpolymer of tetramethylene glycol reacted with an acid mixture of 70% terephthalic acid, 10% isophthalic acid, and 20% azelaic acid and (2) a copolymer of ethylene glycol reacted with 50% terephthalic acid and 50% sebasic acid. Obviously the proportions of the reactants can vary within reasonable limits without affecting materially the functional properties of the polyester blend. Specifically, it would be expected that the top coating material would exhibit the desired characteristics when the above reactants are varied over ranges of the order of ±50% of the recited percentages.

Ingredient 1 of the VAR 5825 is the top coating material referred to herein as VAR 5126 and ingredient 2 as VMR 415. Both materials are available from Goodyear Tire and Rubber Co. The specifics of the preparation of the terpolymer VAR 5126 are contained in U.S. Pat. No. 3,423,281 and details on the preparation of VMR 415 appear in U.S. Pat. Nos. 2,765,250 and 2,765,251.

Proper extrusion of the top coating material is important in obtaining the desired properties of the universal cordage. Quench temperature, draw down ratio line speed and polymer melt tempeature play an important role in determining end product properties. To this end an extrusion profile ot 350° F. for both the top-coating and the underlying PVC is utilized, which ensures maximum adhesion between the polymers and limits degradation of the vinyl. Optimization of the extrusion parameters enables production of a clear coating at a line speed of about 400 fpm with quench water temperature of 40°-50° F. The extrusion is of the pressure type with the tooling being such that the die opening is about 33% larger than the final configuration of the jacket. Upon heat setting or oven aging at 270° F., no large crystal sites are formed, maintaining a clear polyester film.

The VAR 10013-A top coating material is stabilized against heat and light degradation by including about 0.2 part by weight per 100 parts by weight of the composition of Irganox 1010, a high molecular weight hindered phenolic antioxidant. Irganox 1010 is a tetrakis [methylene (3,5-di-tert- butyl-4-hydroxyhydrocinnamate)] methane. Such a stabilizer is available commercially from the CIBA-GEIGY Corporation and is described in a brochure designated A-88 Sup A-32 5 M125. However, other suitable stabilizers can be used as well.

Also, provided in the top coating composition VAR-10013-A is a lubricant. A preferred concentration of the lubricant is about 0.3 part by weight per 100 parts of weight of the composition. A suitable lubricant is a stearic acid lubricant which as indicated hereinbefore is available commercially from Emery Industries.

The use of a top coating material provides many advantages. Aside from its excellent mechanical properties, the top coating prevents the exudation of plasticizer from the underlying PVC compositions. Although a more expensive plasticizer may be used for the outer jacket to reduce any possibility of plasticizer migration, certainly a less expensive plasticizer may be used for the inner jacket which comprises the majority of the material of the jacketing.

One of the more important mechanical properties of the cordage 17 is its flexural modulus. This property is indicative of the amount of force which is necessary to extend a coated cordage and of its springback behavior. Obviously, the cordage cannot be so stiff that excessive force is required to extend the cordage which also would cause excessively high retractibility. On the other hand, the cord must have sufficient retractability so that it does not remain extended after forces have been applied. Sample of a VAR 10013-A top coating were tested in accordance with ASTM D 790 2"/min. and the results were as follow:

TABLE I

| Sample | Flexural Modulus, psi |
|---|---|
| 1 | 24,300 |

TABLE I-continued

| Sample | Flexural Modulus, psi |
|---|---|
| 4 | 23,700 |
| 14 | 23,400 |
| 10 | 25,500 |
| 20 | 23,100 |
| 30 | 23,000 |
| 40 | 22,000 |
| 50 | 21,000 |
| 60 | 23,000 |

Other properties of the VAR 10013-A top coating material include a melt point which at a minimum is 153° C. and which at a maximum is 170° C. as tested in accordance with ASTM D 3275 Section 8.4 DSC 10° C./minute. Also, it has a thermal stability of 10 minutes and a minimum yield strength of 1400 psi when samples are tested in accordance with ASTM 638.

Another property of the top coating material relates to its elongation at break. This property is indicative of the percent elongation to which a cordage is subjected before the top coating material cracks. Samples of VAR 10013-A with the corresponding percent elongation at break being as follows:

TABLE II

| Sample | Elongation at Break |
|---|---|
| 3-BD-14 | 744 |
| 6-BD-14 | 780 |
| 7-BD-14 | 733 |
| 10-BD-14 | 740 |
| 1-BD-15 | 495 |
| 4-BD-15 | 465 |
| 14-BD-15 | 455 |

Physical properties of the top coating material are summarized as shown in Table III below:

TABLE III

| Property | VAR 100013 | Test Method |
|---|---|---|
| Specific gravity | 1.15-1.25 | ASTM D-792 |
| Shore D Hardness | 45-55 | ASTM D-785 |
| Yield Strength (psi) | 1400 | ASTM D-638 2" min. |
| Elongation (%) | 400 | ASTM D-638 2" min. |
| Low Temp. Brittleness (degree C.) | 2 of 10 max at −17° C. | ASTM D-746 |
| Melt Point (degree C.) | 153-170 | DSC |
| Torsional Modulus (psi) | 8000 | ASTM D-1043 |
| Stiffness Modulus | 16,000-22,000 | ASTM D-747 |
| Flexural Modulus (psi) | 22.000 | ASTM D-790 |
| Crystalization (degree C.) | 110 | |

With the cord structure of this invention, it becomes economically feasible to include a top coating in the shorter length cords and hence derive the excellent resistance to maring and stain which is provided by the top coating. During investigations of processing the material it was found that the top coating material can be extruded in a single extrusion line along with the underlying PVC jackets and, when properly quenched, remains essentially clear. This contrasts with the common tendency of extruded plastics to crystallize in a structure that is, to varying degrees, opaque. The top coating 56 also was found to improve the scuff resistance and the crush resistance of the cordage. Also, the use of a plasticizer barrier allows greater flexibility in the choice of plasticizers used for the PVC. Plasticizers that migrate to the surface of the plastic and mar furniture finish or evaporate can in many cases be used if the barrier layer is applied.

Because of the enhanced retractility which is provided by the top coating layer 56, it becomes unnecessary to use a HYTREL® plastic material for the insulation 18 even for the twelve foot cords. Instead, a blend of polypropylene and synthetic rubber material which is less expensive than the HYTREL® plastic material may be used. In the alternative, polypropylene could be used.

Advantageously, the cordage of this invention may be used for any of the customary length cords. Savings from presently used twenty-five foot cord are realized because of the use of a dual jacket with the inner not being colored and comprising a less expensive composition than the outer. For the twelve foot cords, a less expensive conductor insulation is used and a top coating provides desired retractility. For the six foot cords, there may be an increase in cost because of the top coating but this should be offset by the dual jacket system. Further, overall costs should be lower because of the need to inventory only one structure of cordage for any of the customary length cords.

Although the inner jacket has been disclosed in the preferred embodiment as being a PVC, other materials may be used. What is important is that the material of the inner jacket be relatively inexpensive inasmuch as it comprises by far the largest percentage of the jacket cross section. It must be flexible and must have acceptable dielectric properties.

Figure 6:
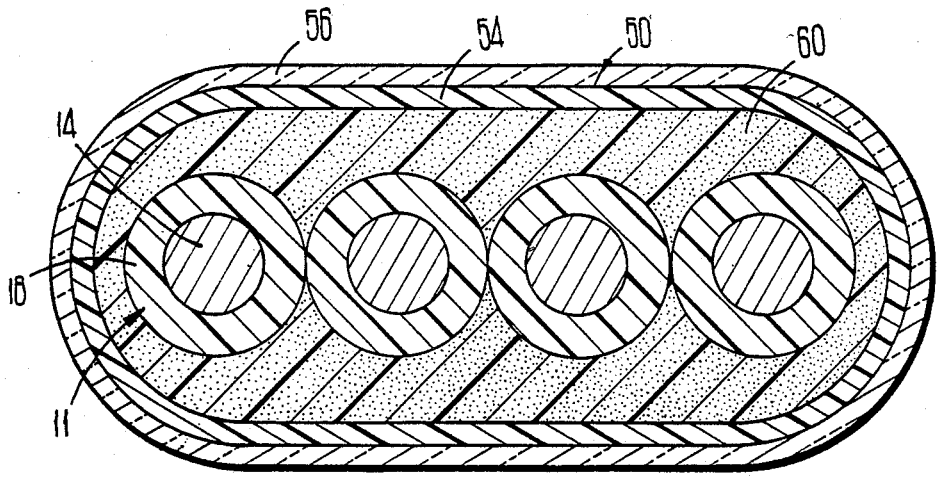
FIG. 6 is a cross-sectional end view of an alternate embodiment of the cordage of this invention.

Another material which may be used as the inner jacket is a cellular plastic material such as cellular PVC. Such an inner jacket is designated by the numeral 60 in FIG. 6. Typically, such a material would have a percent expansion in the range of about 30–50%. Over the cellular material is disposed the outer jacket 54, preferably with a colorant constituent, and the transparent top coating layer 56 which are used in the preferred embodiment shown in FIG. 4.

It is to be understood that the above-described arrangements are simply illustrative of the invention. Other arrangements may be devised by those skilled in the art which will embody the principles of the invention and fall within the spirit and scope thereof.

We claim:

1. A cordage for transmitting communications signals, said cordage comprising:

a longitudinally extending signal transmission medium having an insulation cover;

an inner jacket which comprises a plastic material and which encloses said at least one transmission medium;

an outer jacket which comprises a plastic material, which encloses said inner jacket and which has a thickness that is substantially less than the thickness of said inner jacket; and a surface coating which covers said outer jacket and which is a composition comprising an elastomeric copolyester.

2. The cordage of claim 1 in which the inner and the outer jackets each comprise a plasticized polyvinyl chloride material.

3. The cordage of claim 2 in which said signal transmission medium includes a plurality of individually insulated conductors.

4. The cordage of claim 3, wherein the plurality of individually insulated conductors are disposed in a planar array.

5. The cordage of claim 1 in which said outer jacket includes a constituent to provide the cordage with a predetermined color and said surface coating is transparent.

6. The cordage of claim 1, wherein said surface coating comprises a polyester blend of a terpolymer of tetramethylene glycol reacted with terephthalic acid, isophthalic acid, and azelaic acid, and a copolymer of ethylene glycol reacted with terephthalic acid and sebasic acid.

7. The cordage of claim 6 in which the terpolymer contains the recited constituents in amounts of approximately 70%, 10% and 20% respectively and the copolymer contains the recited constituents in amounts of approximately 50% and 50% respectively.

8. The cordage of claim 1, wherein the materials of said inner and outer jackets and said surface coating are such that said inner and outer jackets are bonded together and said outer jacket is bonded to said surface coating.

9. The cordage of claim 1, wherein said inner and said outer jackets each comprises a polyvinyl chloride composition and said surface coating composition comprising an elastomeric copolyester contains a stabilizer component and a lubricant.

10. The cordage of claim 9, wherein said surface coating composition comprises about 99.5 parts by weight of said elastomeric copolyester, about 0.2 part by weight of said stabilizer and about 0.3 part by weight of said lubricant.

11. The cordage of claim 9 in which the surface coating is transparent and said polyvinyl chloride composition of said outer jacket includes a colorant constituent.

12. The cordage of claim 1 in which said cordage is wound in a coiled configuration and said cordage is tapered with the diameter of coils adjacent to at least one end of the cordage being less than the diameter of the coils in a center portion of the cordage.

13. The cordage of claim 1, wherein said inner jacket comprises a cellular plastic material.

14. The cordage of claim 1, wherein said cordage is heat set into a retractile configuration and said insulation cover comprises a plastic material which has a melt point above the temperature at which said cordage is heat set into said retractile configuration and which cooperates with said surface coating to provide said cordage with desired extensibility and retractility properties.

15. The cordage of claim 14 in which said signal transmission medium includes a plurality of individual conductors each with an insulation cover and wherein said insulation cover for each conductor comprises a polypropylene plastic material composition.

16. The cordage of claim 14 in which said signal transmission medium includes a plurality of individual tinsel conductors each encompassed by an insulation cover comprising a blend of polypropylene and synthetic rubber.

17. A retractile telephone cord, which comprises:

an electrical connector, which includes a housing; and a length of cordage which is wound in a coiled configuration and which is assembled to the housing, said cordage comprising:

a plurality of electrical signal transmission media; and an insulation material which covers each of said electrical signal transmission media; and a jacket system enclosing said electrical signal transmission media and comprising:

an inner jacket comprising a polyvinyl chloride material;

an outer jacket covering said inner jacket and having a thickness which is substantially less than that of said inner jacket, said outer jacket comprising a composition of matter comprising a plasticized polyvinyl chloride which includes a colorant constituent; and a surface coating which covers said outer jacket and which comprises an elastomeric copolyester, a stabilizer and a lubricant, said surface coating being transparent.

18. The retractile telephone cord of claim 17, wherein said elastomeric copolyester of said surface coating which covers said outer jacket comprises a polyester blend of a terpolymer of tetramethylene glycol reacted with terephthalic acid, isophthalic acid and azelaic acid, and a copolymer of ethylene glycol reacted with terephthalic acid and sebasic acid.

* * * * *